US010376039B2

(12) United States Patent
Jungnickel et al.

(10) Patent No.: US 10,376,039 B2
(45) Date of Patent: Aug. 13, 2019

(54) HEAD FOR AN ORAL CARE IMPLEMENT

(71) Applicant: The Procter & Gamble Company, Cincinnati, OH (US)

(72) Inventors: Uwe Jungnickel, Königstein (DE); Marlis Hübner, Bad Soden (DE); Kathi Ballmaier, Wehrheim (DE); Sören Wasow, Langenselbold (DE); Fiona Harrington, Bad Soden (DE)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 233 days.

(21) Appl. No.: 15/617,861

(22) Filed: Jun. 8, 2017

(65) Prior Publication Data

US 2017/0273448 A1 Sep. 28, 2017

Related U.S. Application Data

(63) Continuation of application No. 14/682,824, filed on Apr. 9, 2015, now Pat. No. 9,675,168.

(30) Foreign Application Priority Data

| | | |
|---|---|---|
| Apr. 11, 2014 | (EP) | 14164368 |
| Jan. 7, 2015 | (EP) | 15150297 |
| Apr. 9, 2015 | (WO) | US2015/025017 |

(51) Int. Cl.

| | |
|---|---|
| ***A46B 9/04*** | (2006.01) |
| ***A46B 9/02*** | (2006.01) |
| ***A46B 9/06*** | (2006.01) |

(52) U.S. Cl.

CPC ..... *A46B 9/04* (2013.01); *A46B 9/02* (2013.01); *A46B 9/025* (2013.01); *A46B 9/028* (2013.01);

(Continued)

(58) Field of Classification Search

CPC .. A46B 9/04; A46B 9/02; A46B 9/025; A46B 9/028; A46B 9/06

See application file for complete search history.

(56) References Cited

U.S. PATENT DOCUMENTS

| | | | |
|---|---|---|---|
| 5,926,897 | A | 7/1999 | Volpenhein |
| 6,726,789 | B1 | 4/2004 | Weihrauch |

(Continued)

FOREIGN PATENT DOCUMENTS

| | | | |
|---|---|---|---|
| WO | WO 2009/000903 | A1 | 12/2009 |
| WO | WO 2010/069917 | A1 | 6/2010 |
| WO | WO 2010/069919 | A1 | 6/2010 |

OTHER PUBLICATIONS

European Search Report, dated Oct. 3, 2014, 2 pages.

*Primary Examiner* — Shay Karls
(74) *Attorney, Agent, or Firm* — Vladimir Vitenberg

(57) ABSTRACT

A head for an oral care implement comprises a mounting surface and at least one tuft extending from the mounting surface. The tuft comprises a first group of filaments and at least a second group of filaments. The first group of filaments is surrounded by the second group of filaments. The filaments of the first group have a longitudinal axis and a cross-sectional area extending in a plane perpendicular to the longitudinal axis, and the cross sectional area has a substantially circular shape with a first diameter. The filaments of the second group have a longitudinal axis and a cross-sectional area extending in a plane perpendicular to the longitudinal axis, and the cross sectional area has a substantially circular shape with a second diameter. The first diameter is smaller than the second diameter. The first diameter is about 0.15 mm to about 0.16 mm, preferably about 0.152 mm (6 mil) and the second diameter is about 0.17 mm to about 0.18 mm, preferably about 0.178 mm (7 mil).

18 Claims, 6 Drawing Sheets

(52) U.S. Cl.
CPC ..... *A46B 9/06* (2013.01); *A46B 2200/1066* (2013.01)

(56) References Cited

U.S. PATENT DOCUMENTS

| | | | | |
|---|---|---|---|---|
| 9,066,579 | B2 * | 6/2015 | Hess | A46B 9/026 |
| 2007/0283517 | A1 | 12/2007 | Blanchard | |
| 2010/0115724 | A1 | 5/2010 | Huang | |
| 2013/0139338 | A1 | 6/2013 | Hess et al. | |

* cited by examiner

HEAD FOR AN ORAL CARE IMPLEMENT

FIELD OF THE INVENTION

The present disclosure is concerned with a head for an oral care implement and in particular with such a head comprising at least one tuft having filaments of different diameters.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

It is known that filaments forming one tuft often have substantially the same dimensions and characteristics. While toothbrushes comprising these types of tufts clean the outer buccal face of teeth adequately, they are not as well suited to provide adequate removal of plaque and debris from the gingival margin, interproximal areas, lingual surfaces and other hard to reach areas of the mouth.

Tufts composed of two different types of filaments, so called tuft-in-tufts, are also known in the art. In general, each type of filament is arranged in a group, wherein an inner group is substantially coaxially enclosed by an outer group to form the tuft. For example, a toothbrush head is known having a mounting surface from which tufts comprising a plurality of hairs extend. The tufts comprise harder hairs and softer hairs wherein the harder hairs are enclosed by the softer hairs to keep the gum from being injured as the soft hairs contact the user's gum earlier than the hard hairs do.

The tuft-in-tufts known in the art do not provide gentle and effective brushing performance.

It is an object of the present disclosure to provide a head for an oral care implement which provides improved cleaning properties, in particular with respect to gentle and effective cleaning performance It is also an object of the present disclosure to provide an oral care implement comprising such head.

SUMMARY OF THE INVENTION

In accordance with one aspect, a head for an oral care implement is provided that comprises:

a mounting surface, and at least one tuft extending from the mounting surface, the tuft comprising a first group of filaments and at least a second group of filaments, the first group of filaments being surrounded by the second group of filaments, the filaments of the first group having a longitudinal axis and a cross-sectional area extending in a plane perpendicular to the longitudinal axis, and the cross sectional area having a substantially circular shape with a first diameter, and the filaments of the second group having a longitudinal axis and a cross-sectional area extending in a plane perpendicular to the longitudinal axis, and the cross sectional area having a substantially circular shape with a second diameter, wherein the first diameter is smaller than the second diameter, and wherein the first diameter is about 0.15 mm to about 0.16 mm, preferably about 0.152 mm (6 mil) and the second diameter is about 0.17 mm to about 0.18 mm, preferably about 0.178 mm (7 mil).

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
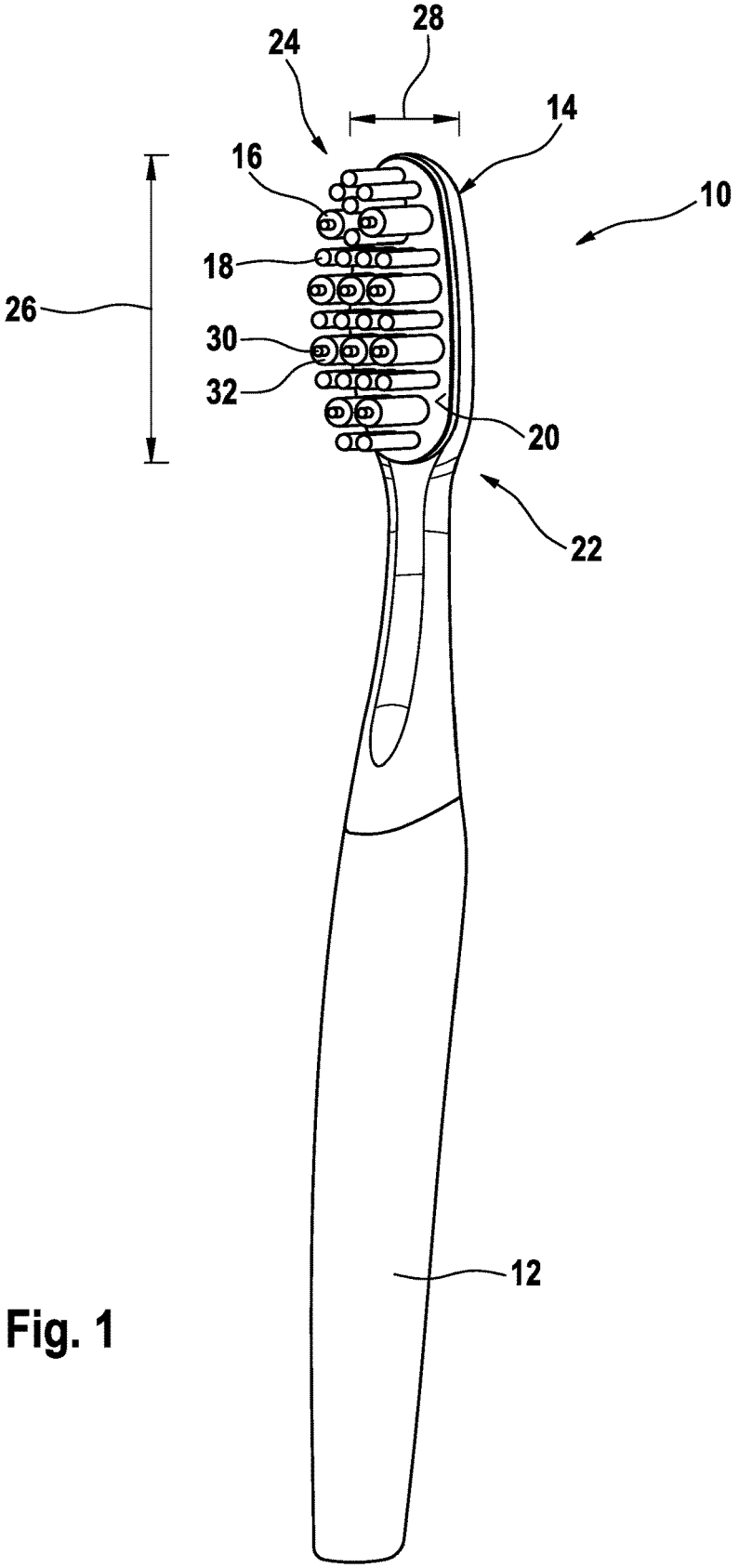
FIG. 1 shows a perspective view of an example embodiment of an oral care implement.

A head for an oral care implement in accordance with the present disclosure comprises at least one tuft which extends from a mounting surface of the head. The tuft comprises a first group of filaments and a second group of filaments. The first group of filaments may be completely surrounded, optionally coaxially surrounded, by the second group of filaments.

Each filament has a longitudinal axis and a cross-sectional area extending in a plane perpendicular to the longitudinal axis. The cross sectional area has a substantially circular shape with a diameter. The diameter of the filaments of the first group, in the following referred to as "first diameter", is smaller than the diameter of the filaments of the second group, in the following referred to as "second diameter". In other words, the filaments of the first group may be softer than the filaments of the second group.

In other words, the tuft is composed of two types of separated/single or isolated filaments which differ in terms of diameter and which are arranged in respective groups. In the context of this disclosure, a "group of filaments" means at least 5 single filaments having substantially the same diameter. The group of filaments having the smaller diameter may comprise at least three times the number of filaments of the other group having the greater diameter.

Since the filaments of the second group which have the larger diameter show a higher bending stiffness compared to the filaments of the first group which have the smaller diameter, the second group of filaments may provide a counterforce to the filaments of the first group. Thus, the second group of filaments may provide the softer filaments of the first group with increased stability and higher bending stiffness during a brushing process while the softer filaments may perform a gentle brushing action. The increased stability/bending stiffness may allow the softer filaments to transmit sufficient contact pressure to clean the teeth effectively.

The diameter of the filaments of the first group is about 0.15 mm to about 0.16 mm, optionally about 0.152 mm (6 mil) and the diameter of the filaments of the second group is about 0.17 mm to about 0.18 mm, optionally about 0.178 mm (7 mil). Experiments revealed that the at least one tuft in accordance with the present disclosure does not only provide improved cleaning/plaque removal properties but also improved cleaning perception (cf. Comparison Experiments).

The filaments of the first group may have a first length and the filaments of the second group may have a second length and the first length may be different from the second length. In the context of this disclosure, the length of a filament may be defined by the extension of the filament measured from its lower end being secured at the mounting surface of the head to its upper free/loose end.

The first length may be longer than the second length. In other words, the filaments of the first or inner group may have a greater length compared to the filaments of the second or outer group, i.e. longer filaments may be surrounded by shorter and stiffer filaments. Thus, the longer filaments may be supported by the shorter filaments which may provide the longer filaments with more stability which may result in better cleaning capabilities. In case a force is applied to the tuft, the group of shorter filaments acts as a counterforce for the group of longer filaments resulting in a higher bending stiffness of the group of longer filaments. In other words, the second group of shorter filaments may act as a support structure for the first group of longer filaments. The increased stability/bending stiffness may allow the longer filaments to transmit sufficient contact pressure to clean the teeth effectively and to force the filaments to penetrate into interproximal areas. Thus, relatively thin filaments can be used in an interior part of the tuft in order to access and clean narrow interdental spaces with sufficient contact pressure during a brushing process.

The relatively long and thin filaments may provide a gentle cleaning action; a stinging sensation/unpleasant feeling on the gums during brushing may be substantially avoided. A head for an oral care implement is provided which may provide both, good interdental penetration and cleaning properties of the longer filaments due to sufficient stability/bending stiffness, and a gentle cleaning effect substantially without a pricking sensation while the shorter filaments clean the buccal, lingual and occlusal surfaces of the teeth adequately.

The difference in length between the first length and the second length may be about 1.1 mm to about 1.9 mm, optionally from about 1.3 mm to about 1.7 mm, further optionally about 1.5 mm. Such difference in length may allow good penetration of the greater filaments into interdental spaces whereas the shorter filaments may clean the buccal, lingual and occlusal surfaces of the teeth adequately. A head for an oral care implement is provided that may remove plaque and other residues more effectively both, on substantially flat surfaces as well as in interdental spaces. The group of longer filaments and the group of shorter filaments work synergistically together. Test results revealed that the difference in length between the longer and the shorter group of filaments is critical for interdental penetration and the overall cleaning capabilities. In case the length difference is too small, the longer tufts may not penetrate deeply enough into the interproximal areas to provide sufficient plaque removal. However, a length difference being too large may prevent the shorter filaments from touching and cleaning the buccal, lingual and occlusal surfaces of the teeth.

Surprisingly, it was found out that a length difference of about 1.5 mm provides both, improved interdental cleaning properties by means of the longer filaments and good cleaning performance on the buccal, lingual and occlusal surfaces of the teeth by means of the shorter filaments. A tuft consisting of filaments with substantially no difference in length showed substantially no interdental penetration of any filaments. A length difference below 1 mm provided poor interdental cleaning performance whereas a length difference of about 2.5 mm showed that the shorter filaments were substantially not in contact with the buccal, lingual and occlusal surfaces of the teeth.

The length of the shorter filaments measured from the mounting surface to their upper free ends may be from about 8 mm to about 12 mm, optionally about 11 mm.

Each group of filaments and the overall tuft may have a longitudinal axis and a cross-sectional area extending in a plane perpendicular to the longitudinal axis. The cross-sectional area of the first group and/or the second group may have a circular or a non-circular shape. For example, the cross-sectional shape can be ellipsoid, squared, rectangular, triangular, cross-shaped, or it can be a prolate ellipsoid with flattened long sides, even though other shapes may be considered as well. The different groups of filaments may have various cross-sections so that various shapes/cross-sections of the overall tuft may be achieved.

The overall tuft may have a substantially circular cross-sectional shape with a diameter of about 2.8 mm to about 3.2 mm, optionally of about 3 mm. In addition or alternatively, the cross sectional area of the first group of filaments may have a substantially circular shape with a diameter of about 0.8 mm to about 1.2 mm, optionally of about 1 mm. Such tuft dimensions may provide both, good interdental penetration properties and effective buccal, lingual and occlusal surface cleaning.

The filaments of the first and/or second group may be tapered filaments having a pointed tip. Tapered filaments may achieve optimal penetration into areas between two teeth as well as into gingival pockets during brushing and may provide improved cleaning properties. The tapered filaments may have an overall length extending above the mounting surface of about 10 mm to 16 mm, optionally of about 12.5 mm, and a tapered portion of about 5 mm to 10 mm measured from the tip of the filament. The pointed tip may be needle shaped, may comprise a split or a feathered end. The tapering portion may be produced by a chemical and/or mechanical tapering process.

The tuft may have a free end having a topography which may be linear, concave, convex or dome shaped. The first and/or the second group of filaments may have a specific topography/geometry at the free end, i.e. at the upper top surface, which may be shaped to optimally adapt to the teeth contour and, thus, to remove plaque more effectively. In further embodiments, the topography may be chamfered or rounded in one or two directions or may be pointed.

In addition or alternatively, the filaments of the first group and the filaments of the second group may further differ from each other at least in one of the following characteristics: bending stiffness, material, texture, cross sectional shape, color and combinations thereof. The filaments may be crimped, notched, dimpled, flocked or may comprise a series of ribs, for example. Textured filaments may tend to enhance cleaning effects on the teeth. The filaments may have a circular or non-circular cross-section, in particular the filaments may have a diamond-or cross-shaped cross-section, a triangular or elliptical cross-section, or a cross-section that can be described as a prolate ellipsoid with flattened long sides. Further, the filaments may be flagged at their free ends or may also be hollow. The filaments may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The coloring on nylon indicator material is slowly worn away as the filament is used over time to indicate the extent to which the filament is worn.

In addition or alternatively, the at least one tuft may be inclined with respect to the mounting surface of the head. In other words, the at least one tuft may be oriented at an angle $\alpha$ relative to that portion of the mounting surface of the head from which it extends. The tuft may be angled relative to an imaginary line which is tangent to or co-planar with the mounting surface of the head through which the tuft is secured to the head. The at least one tuft may be oriented at an angle $\alpha$ in a direction that is substantially parallel to the longitudinal extension of the head and/or orthogonal thereto, i.e. across the width of the head. The at least one inclined tuft may provide improved cleaning properties, in particular with respect to interdental areas, as the inclination of the tuft may facilitate that the filaments slide into small gaps between the teeth to clean the interdental areas.

The head may comprise at least two tufts, at least one tuft may be inclined in a direction towards a distal end of the head and at least one tuft may be inclined in a direction towards a proximal end of the head. The term "proximal end of the head" shall mean the end of the head which is proximal to a handle which may be attached to the head, whereas the term "distal end of the head" shall mean the end of the head being opposite to the proximal end of the head, i.e. the free end of the head. In other words, at least one tuft may be angled forward and at least one tuft may be angled backward with respect to the longitudinal extension of the head. As the inclination of the tuft may facilitate that the filaments can slide into interdental areas/spaces in the direction of inclination more easily, the head having at least two tufts which are inclined in opposite directions may improve cleaning properties when the head is moved in said opposite directions. In case the head is moved along its longitudinal extension on the teeth surface, the filaments of the at least two tufts may be forced to penetrate into the interdental spaces in a forward and backward brushing motion, respectively.

The head may comprise at least two rows of tufts, optionally at least three rows of tufts, each row may be arranged substantially along the longitudinal extension of the head and the tufts of each row may be inclined and aligned substantially towards the same direction. The tufts may be inclined in a direction parallel to the longitudinal extension of the head, i.e. along the length of the head, orthogonal thereto, i.e. across the width of the head, or part way between the length and the width of the head. Such tuft arrangement may even further improve the cleaning efficiency of the head.

The tufts of at least a first row may be inclined in a direction towards a proximal end of the head and the tufts of at least a second row may be inclined in a direction towards a distal end of the head. Optionally, at least two rows may be arranged in an alternating manner, thereby describing a so-called criss-cross tuft pattern in a side perspective view of the head. Such tuft pattern may further improve cleaning properties. When the head of an oral care implement is moved in a forward motion along its longitudinal extension, the filaments being inclined in the direction towards the distal end of the head may perform a poke, pivot and slide motion thereby penetrating into interproximal areas from a forward direction. When the head is moved in a backward motion, i.e. in the opposite direction of the forward motion, the filaments being inclined in the direction towards the proximal end of the head may perform the poke, pivot and slide motion thereby penetrating into interproximal areas from the backward direction. Thus, a criss-cross tuft pattern may allow that the filaments penetrate into interproximal areas with every single forward and backward brushing stroke along the occlusal, buccal and lingual surfaces of the teeth.

Optionally, a distance/spacing between the tufts within one row may be adapted/correspond to the width of the teeth. This may allow synchronized penetration of the filaments into multiple interproximal areas/interdental spaces. Due to the fact that the width of the teeth may vary with the position of the jaws and from one person to the other, a distance/spacing between the tufts within a row may be in the range from about 3 mm to about 6 mm.

The angle $\alpha$ between the tuft and the mounting surface of the head—in the following also referred to as "inclination angle"—may be from about 45° to about 89°, optionally from about 60° to about 85°, further optionally from about 65° to about 83°, even further optionally from about 70° to about 80°, even further optionally from about 72° to about 78°, even further optionally about 74°, about 75° or about 76°.

Experiments revealed that filaments having an inclination angle $\alpha$ from about 65° to about 80°, optionally from about 70° to about 80° are more likely to penetrate into interdental gaps. Filaments having an inclination angle $\alpha$ of more than about 80° showed low likelihood of interdental penetration as these filaments bend away from the direction of travel or skip over the teeth.

The inclination angle $\alpha$ may be from about 74° to about 76°, optionally about 74° or about 75°. Surprisingly, it was found, that filaments having an inclination angle $\alpha$ from about 74° to about 76°, optionally about 74° or about 75° may further improve cleaning performance of the head for an oral care implement. Experiments revealed that such filaments are even more likely to penetrate into interdental gaps.

The at least one tuft may be attached to the head by means of a hot tufting process. One method of manufacturing the oral care implement may comprise the following steps: In a first step, tufts may be formed by providing a desired amount of filaments. In a second step, the tufts may be placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head or an oral care implement body comprising the head and the handle may be formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral care implement. In other words, the tufts attached to the head by means of a hot tufting process may be not doubled over a middle portion along their length and may be not mounted in the head by using an anchor/staple. The tufts may be mounted on the head by means of an anchor free tufting process.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of an example embodiment of an oral care implement comprising an example embodiment of a tuft in accordance with the present disclosure, where reference to the Figures is made.

Figure 2:
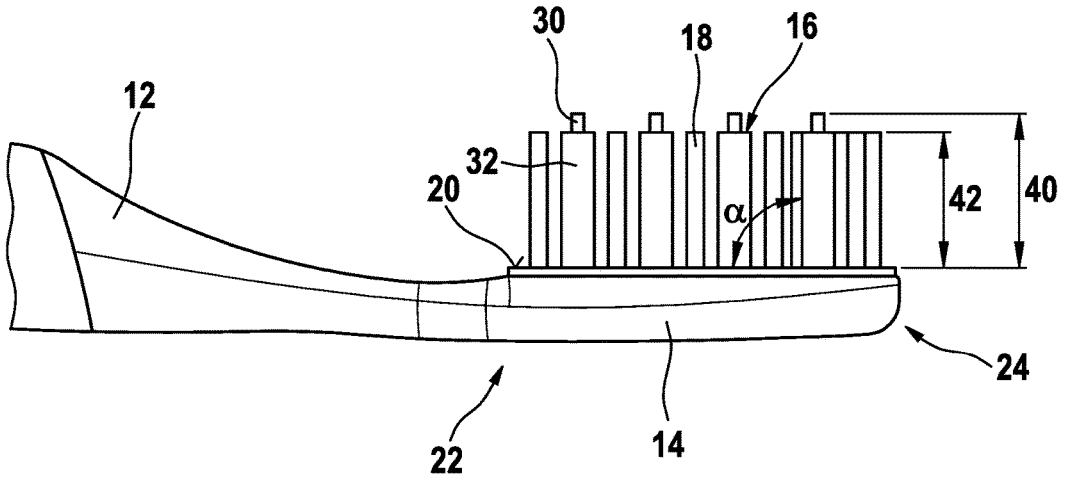
FIG. 2 shows a side view of the oral care implement of FIG. 1.
Figure 3:
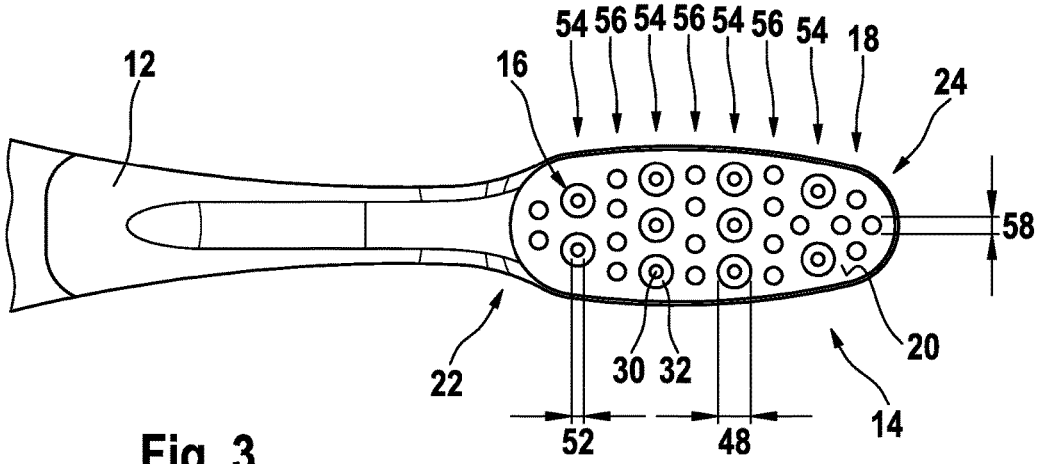
FIG. 3 shows a top down view of the oral care implement of FIG. 1.

FIGS. 1 to 3 show an embodiment of an oral care implement 10, which could be a manual or an electrical toothbrush 10 comprising a handle 12 and a head 14 extending from the handle 12 in a longitudinal direction. The head 14 has a proximal end 22 close to the handle 12 and a distal end 24 furthest away from the handle 12, i.e. opposite the proximal end 22. The head 14 may have substantially the shape of an oval with a length/longitudinal extension 26 and a width extension 28 substantially perpendicular to the length extension 26. Two different types of tufts 16, 18 may be secured to the head 14 by means of a hot tufting process.

The tufts 16, 18 may extend from a mounting surface 20 of the head 14 in a substantially orthogonal manner, i.e. an angle $\alpha$ defined between the tuft 16, 18 and the mounting surface 20 of the head 14 may be about 90°. However, at least one of the tufts 16, 18 may also be inclined with respect to the mounting 20 by an angle $\alpha$ of about 45° to about 89°, optionally from about 60° to about 85°, further optionally from about 65° to about 83°, even further optionally from about 70° to about 80°, even further optionally from about 72° to about 78°, even further optionally about 74°, about 75° or about 76°.

Figure 4:
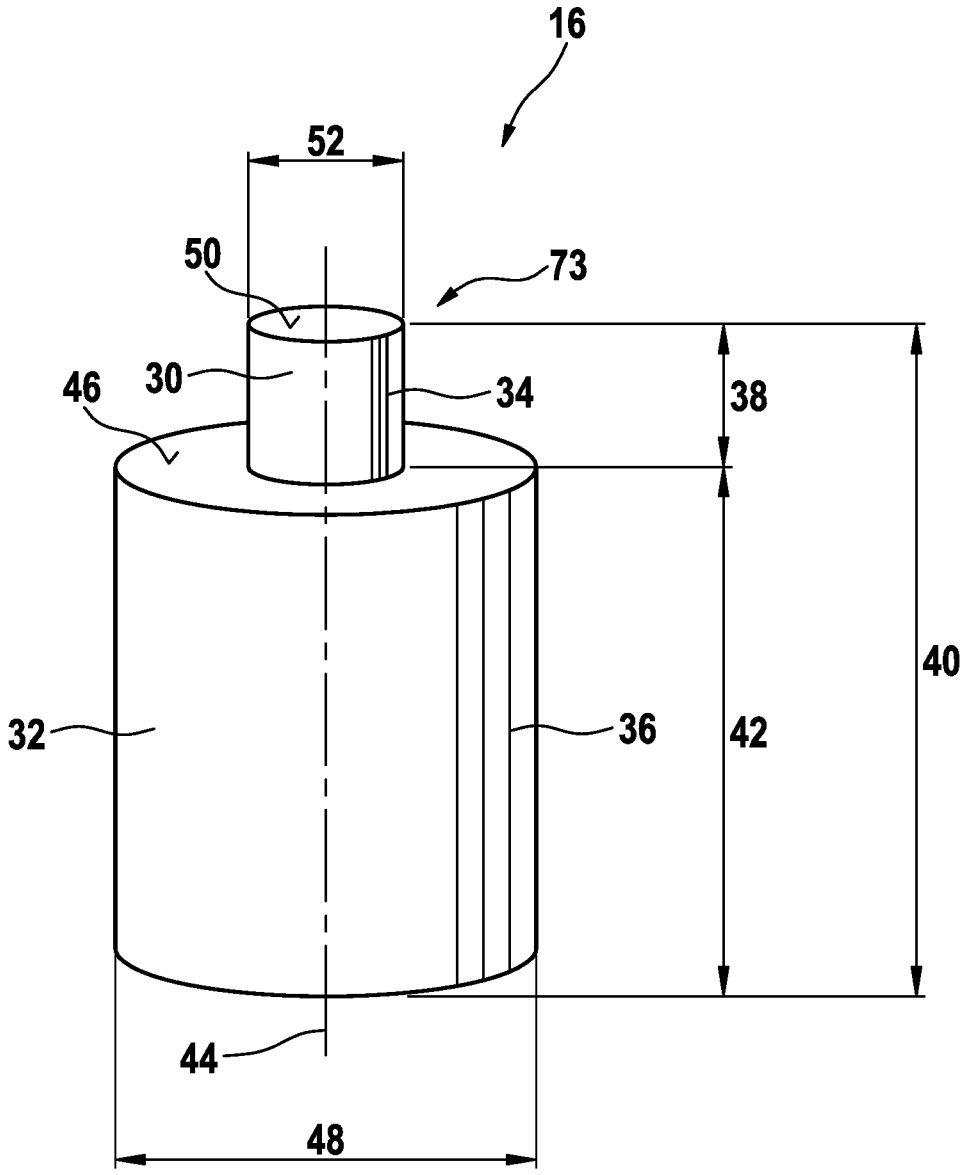
FIG. 4 shows a perspective view of a tuft of the oral care implement of FIG. 1.

One of the tufts 16 in accordance with the present disclosure is illustrated in FIG. 4. The tuft 16 comprises two different groups 30, 32 of filaments 34, 36, wherein an inner first group 30 is completely surrounded by an outer second group 32. The first group 30 comprises filaments 34, one of them being shown in FIG. 5, having a longitudinal axis 66 and a cross-sectional area 67 extending in a plane perpendicular to the longitudinal axis 66. The cross sectional area 67 has a substantially circular shape with a first diameter 68. The second group 32 comprises filaments 36, one of them being shown in FIG. 6, having a longitudinal axis 69 and a cross-sectional area 70 extending in a plane perpendicular to the longitudinal axis 69. The cross sectional area 70 has a substantially circular shape with a second diameter 71, wherein the first diameter 68 is smaller than the second diameter 71.

The diameter of the filaments 34 of the first group 30 may be about 0.15 mm to about 0.16 mm, optionally about 0.1524 mm (6 mil) whereas the diameter of the filaments 36 of the second group 32 may be about 0.17 mm to about 0.18 mm, optionally about 0.1778 mm (7 mil).

The tuft 16 may have a free end 73 having a topography which may be linear, concave, convex or dome shaped.

The filaments 34 of the first group 30 may have a longer first length 40 compared to a shorter second length 42 of the filaments 36 of the second group 32. The difference 38 in length between the filaments 34 of the first group 30 and the filaments 36 of the second group 32 may be about 1.1 mm to about 1.9 mm, optionally about 1.3 mm to about 1.7 mm, optionally about 1.5 mm.

The filaments 36 of the second group 32 may provide the filaments 34 of the first group 30 with a counterforce during a brushing action and, thus, may provide said filaments 34 with increased stability/bending stiffness which may result in increased contact pressure when the filaments 34 of the first group 30 come into contact with the teeth. The increased contact pressure may force the longer filaments 34 to penetrate more easily into interdental spaces wherein a gentle brushing sensation may be provided due to the relatively thin dimensions of the filaments 34.

Figure 5:
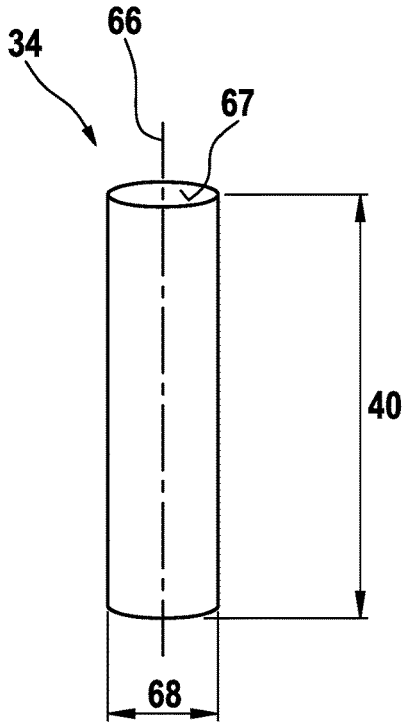
FIG. 5 shows a perspective view of a filament of a first group of the tuft of FIG. 4.
Figure 6:
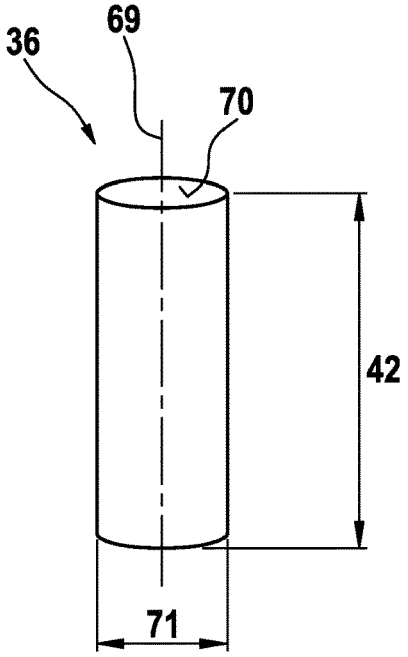
FIG. 6 shows a perspective view of a filament of a second group of the tuft of FIG. 4.
Figure 7:
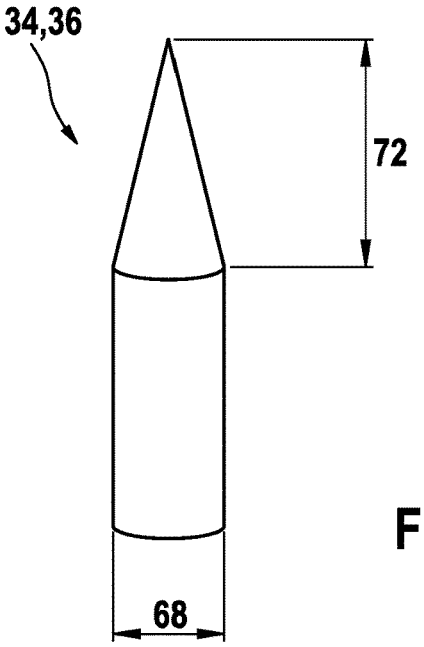
FIG. 7 shows a side view of an alternative embodiment of a filament of the first and/or second group of the tuft of FIG. 4.

The filaments 34, 36 of the first group 30 and/or second group 32 may be tapered filaments having a pointed tip 72 as shown in FIG. 7 or substantially cylindrical filaments with end-rounded tips (cf. FIGS. 5 and 6).

The tuft 16 has a longitudinal axis 44 and a cross-sectional area 46 extending in a plane perpendicular to the longitudinal axis 44. The cross sectional area 46 may have a substantially circular shape with a diameter 48 of about 2.8 mm to about 3.2 mm, optionally of about 3 mm. The first group 30 of filaments 34 may have a cross sectional area 50 with a substantially circular shape having a diameter 52 of about 0.8 mm to about 1.2 mm, optionally of about 1 mm.

Tufts 16 may be arranged in rows 54 which may be aligned substantially parallel to the width extension 28 of the head 14. Four rows 54 of tufts 16 may alternate with four rows 56 which comprise tufts 18. Tufts 18 may have a substantially circular cross-sectional shape with a diameter of about 1.7 mm. The tufts 18 may comprise filaments having a substantially circular cross-sectional shape with a diameter of about 0.1778 mm (7 mil). The filaments of tufts 18 may have a length which is similar to the length 42 of the filaments 36 of the second group 32.

In the toe region at the distal end 24 of the head 14, i.e. furthest away from the handle 12, four tufts 18 may be attached to the mounting surface 20 of the head 14. In addition, one tuft 18 may be arranged between row 54 and row 56 which are closest to the distal end 24 of the head 14.

The filaments of tufts 16 and tufts 18 may be made up from a thermoplastic elastomer material (TPE) with or without an abrasive such as kaolin clay, from nylon with or without an abrasive such as kaolin clay, from polybutylene terephtalate (PBT) with or without an abrasive such as kaolin clay or from nylon indicator material colored at the external surface. The filaments 34 of the first group 30 of tufts 16 may be made up of a different material as the filaments 36 of the second group 32.

COMPARISON EXPERIMENTS

Robot Tests:

A head for an oral care implement in accordance with the present disclosure (example embodiment 1 of the present disclosure, cf. FIGS. 1 to 6) and a head for an oral care implement according to a comparative example (comparative example 1) were compared with respect to their efficiency of plaque substitute removal on artificial teeth (typodonts).

Example Embodiment 1 of the Present Disclosure

Tuft pattern: cf. FIGS. 1 to 3
Length extension of head 12: 37.5 mm
Tufts 16 (cf. FIGS. 4 to 6):
Cross-sectional shape of tuft 16: circular
Diameter 48 of tuft 16: 3 mm
Length 40 of filaments 34 of first group 30: 12.5 mm
Cross-sectional shape of filaments 34 of first group 30: circular
Diameter 68 of filaments 34 of first group 30: 0.1524 mm (6 mil)
Diameter 52 of first group 30: 1 mm
Length 42 of filaments 36 of second group 32: 11 mm
Cross-sectional shape of filaments 36 of second group 32: circular
Diameter 71 of filaments 36 of second group 32: 0.1778 mm (7 mil)
Tufts 18:
Cross-sectional shape of tuft 18: circular
Diameter 58 of tuft 18: 1.7 mm
Length of filaments: 11 mm
Cross-sectional shape of filaments: circular
Diameter of filaments: 0.1778 mm (7 mil)
Material of all filaments: Nylon PA6.12

Comparative Example 1

Length extension of the head: 37.5 mm
Tuft pattern: 10 rows comprising the following number of tufts:
$1^{st}$ row (at the proximal end of the head): 2 tufts
$2^{nd}$ row: 3 tufts
$3^{rd}$ row: 3 tufts
$4^{th}$ row: 4 tufts
$5^{th}$ row: 4 tufts
$6^{th}$ row: 4 tufts
$7^{th}$ row: 4 tufts
$8^{th}$ row: 3 tufts
$9^{th}$ row: 2 tufts
$10^{th}$ row (at the distal end of the head): 1 tuft
Cross-sectional shape of tufts: circular
Diameter of tufts: 1.7 mm
Cross-sectional shape of the filaments of tufts: circular
Diameter of the filaments of tufts: 0.1778 mm (7 mil)
Length of the filaments of tufts: 11 mm
Material of all filaments: Nylon PA6.12

Brushing tests were performed using a robot system KUKA 3 under the following conditions (cf. Table 1):

TABLE 1

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |
| number of moves | 3 | 3 | | |

TABLE 1-continued

| Product | program upper jaw | program lower jaw | force | power supply |
|---|---|---|---|---|
| Movement | | horizontal | | |
| used handle/mould | | No/no | | |

Figure 8:
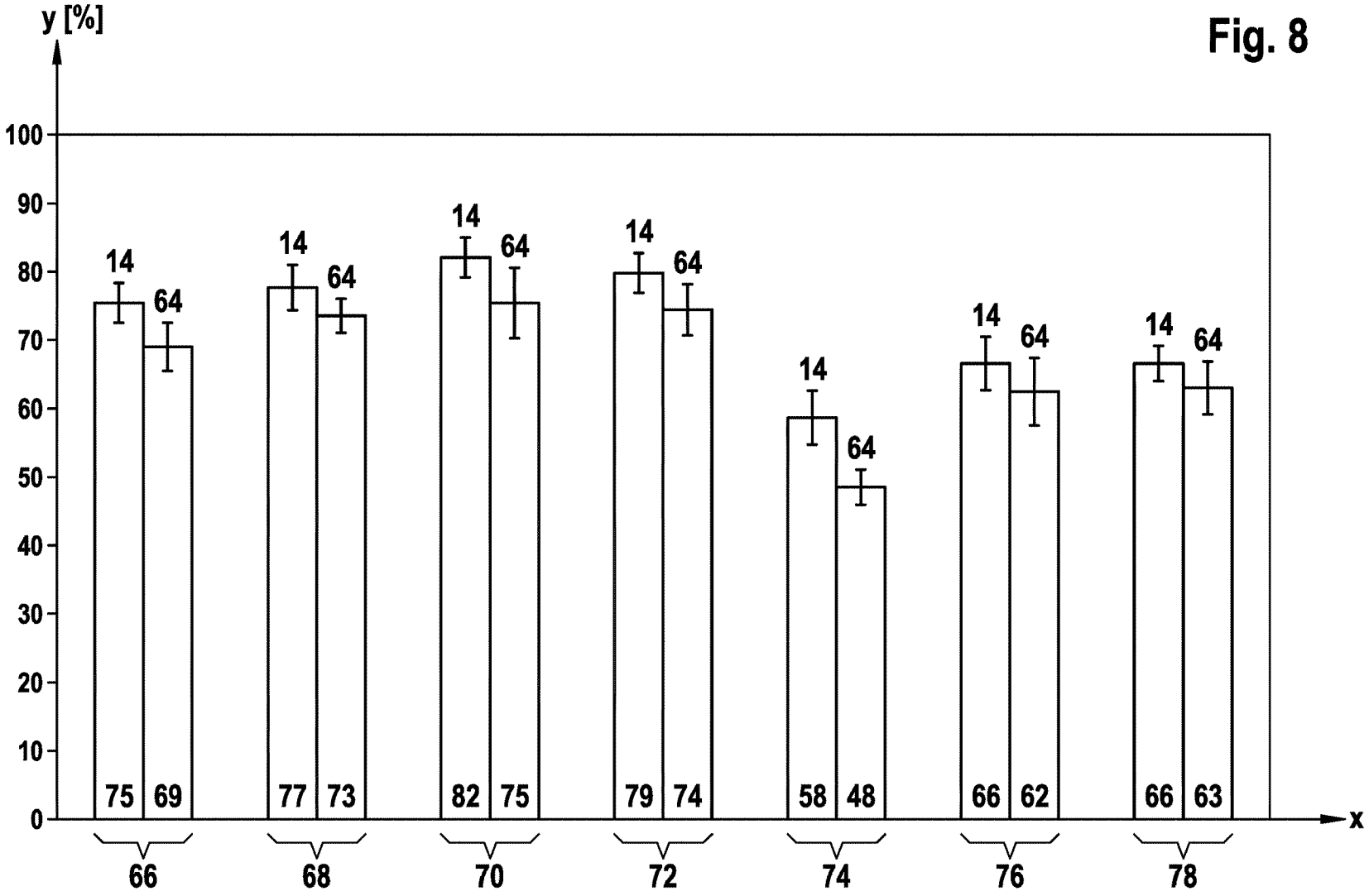
FIG. 8 shows a diagram in which brushing results of an oral care implement according to an embodiment of the present disclosure are compared with brushing results of an oral care implements according to a comparative example embodiment.

FIG. 8 shows the amount of plaque substitute removal in % of the example embodiment 1 (14) and the comparative example 1 (64), each with respect to all tooth surfaces (66), buccal surfaces (68), lingual surfaces (70), lingual and buccal surfaces (72), occlusal surfaces (74), the gum line (76) and interdental surfaces (78).

FIG. 8 clearly shows that example embodiment 1 (14) provides significant improved plaque removal properties with respect to all tooth surfaces (66), buccal surfaces (68), lingual surfaces (70), lingual and buccal surfaces (72), occlusal surfaces (74), the gum line (76) and interdental surfaces (78) compared to comparative example 1 (64).

Sensory Tests:

Further, sensory tests showed performance advantages of oral care implements according to the present disclosure (example embodiments 1 and 2) as compared to care oral implements according to comparative examples (comparative examples 2 to 6). Sensory tests enable trained and experienced panelists to evaluate the effects of oral care implements in comparison with a defined standard. The sensory tests, i.e. sensorial evaluation of different tuft shapes without usage of toothpaste were carried out by 5 trained and experienced sensory experts for the following criteria: interdental cleaning, overall in-mouth perception, stiffness and stability of the tuft pattern. The evaluation of example embodiments 1 and 2 and comparative examples 2 to 6 was as follows:

Example Embodiment 1 of the Present Disclosure as Described Above

Sensorial Evaluation:
Overall cleaning was very good.
The interdental cleaning perception was very good for the majority of panelists.
The brush was perceived as a high efficiency tool having a stable bristle field.
With more pressure, example embodiment 1 was still stable and the bristles were not bending away resulting in good interdental cleaning perception.
Perfect setup.

Example Embodiment 2 of the Present Disclosure as Described Above, However with Four Rows Arranged Next to Each Other Sensorial Evaluation:
The brush is very soft and gentle on gums.
The higher tufts penetrate between teeth and are flexible enough to allow the lower tufts to have a lot of bristle contact on teeth.
Interdental penetration is high.
Perfect setup.

Comparative Example 2

Figure 9:
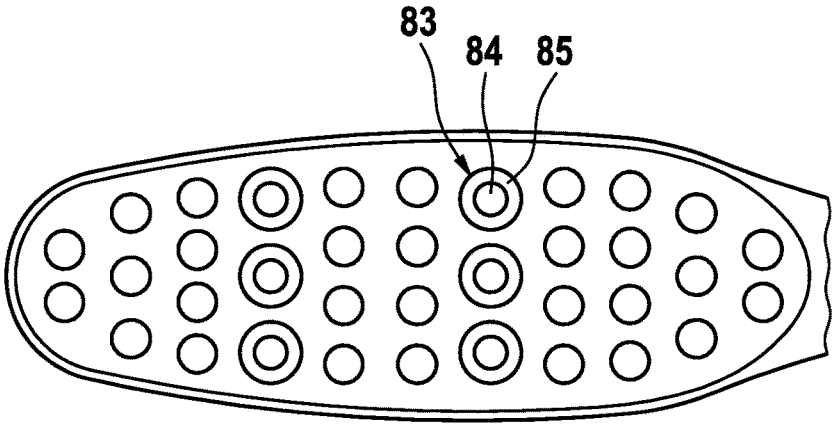
FIG. 9 shows a top-down view of a comparative example embodiment of an oral care implement.

Arrangement of tuft pattern: cf. FIG. 9
Cross-sectional shape of tuft 83: circular
Diameter of tuft 83: 3 mm
Length of filaments of inner group 84: 12.5 mm Cross-sectional shape of filaments of inner group 84: circular
Diameter of filaments of inner group 84: 0.1524 mm (6 mil)
Diameter of inner group 84: 1 mm
Length of filaments of outer group 85: 11 mm
Cross-sectional shape of filaments of outer group 85: circular
Diameter of filaments of outer group 85: 0.1524 mm (6 mil)
Material of all filaments: Nylon PA6.12
Sensorial Evaluation:
The overall character is very similar to a flat trim brush; the tuft-in-tufts are hardly perceivable.
If at all, the tuft-in-tufts are skipping over the teeth rather than really touching the surface of the teeth.
The brush is very gentle and soft and adapts well to the teeth, because the bristle field is very dense.
The overall cleaning perception is good with the brush, because there are many soft bristles.
The tuft-in-tufts are slightly perceivable between teeth when scrubbing over the teeth, but they are very soft and bend away easily.
The bristles are hardly perceivable along the gum-line but if touching gums they appear slightly poky.
More or less pressure does not have an influence on the perception of the tuft-in-tufts. However with more pressure the tuft-in-tufts become "order-less" and bend away, so that the brush looks slightly worn out.

Comparative Example 3

Figure 10:
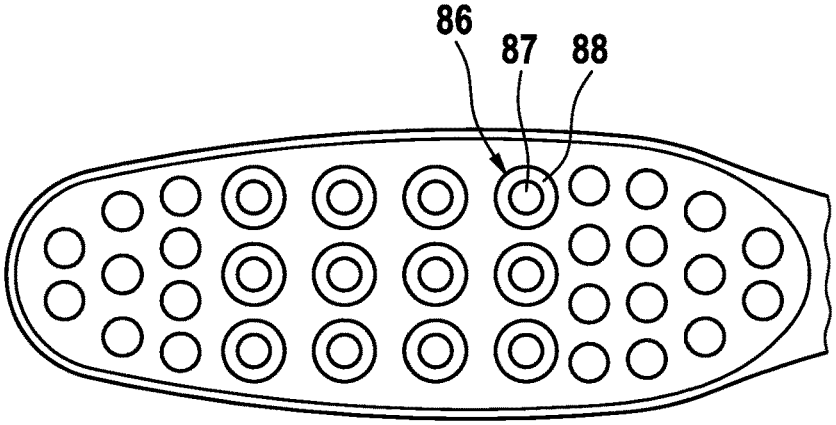
FIG. 10 shows a top-down view of another comparative example embodiment of an oral care implement.

Arrangement of tuft pattern: cf. FIG. 10
Cross-sectional shape of tufts 86: circular
Diameter of tuft 86: 3 mm
Length of filaments of inner group 87: 12.5 mm
Cross-sectional shape of filaments of inner group 87: circular
Diameter of filaments of inner group 87: 0.1524 mm (6 mil)
Diameter of inner group 87: 1 mm
Length of filaments of outer group 88: 11 mm
Cross-sectional shape of filaments of outer group 88: circular
Diameter of filaments of outer group 88: 0.1524 mm (6 mil)
Material of all filaments: Nylon PA6.12
Sensorial Evaluation:
The tuft-in-tufts are slightly perceivable between teeth but not very distinctive along the gum-line.
The brush feels very compact and slightly chunky in mouth.
There is a lot of "action" in mouth and the larger tuft-in-tufts give a good overall cleaning perception.
The brush feels very dense and supportive (good control of bristles during brushing).
The overall brush is very gentle on gums, because there are many soft bristles.
Even with more pressure the brush feels very dense and stable.
With less pressure the tuft-in-tufts are more perceivable between teeth.
The perception in-mouth is similar with scrubbing and circular brushing movements.

Comparative Example 4

Figure 11:
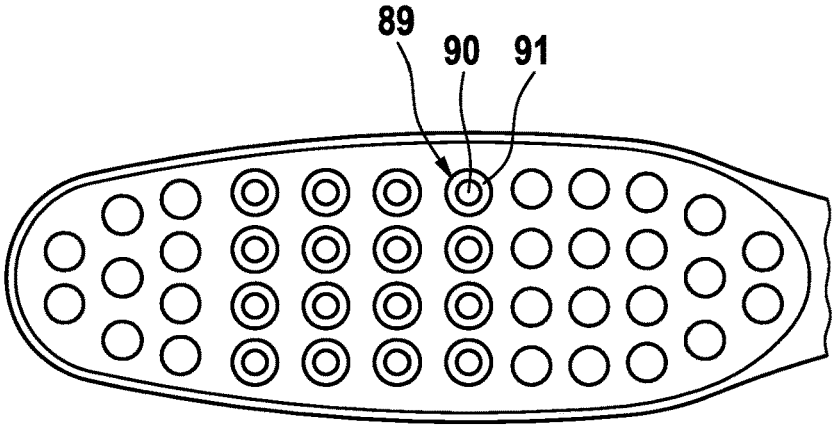
FIG. 11 shows a top-down view of another comparative example embodiment of an oral care implement.

Arrangement of tuft pattern: cf. FIG. 11
Cross-sectional shape of tuft 89: circular
Diameter of tuft 89: 2 mm
Length of filaments of inner group 90: 12.5 mm
Cross-sectional shape of filaments of inner group 90: circular
Diameter of filaments of inner group 90: 0.1524 mm (6 mil)
Diameter of inner group 90: 1 mm
Length of filaments of outer group 91: 11 mm
Cross-sectional shape of filaments of outer group 91: circular
Diameter of filaments of outer group 91: 0.1524 mm (6 mil)
Material of all filaments: Nylon PA6.12
Sensorial Evaluation:
The brush feels very agile and the bristles are skipping over the teeth.
The brush very soft and the bristles bend away easily so that the overall brush character is rather undefined.
The overall brush character is still very similar to a flat trim brush, but the tuft-in-tufts are perceivable between teeth and also along the gum-line.
The small tuft-in-tufts are slightly poky on gums, because they bend away rather "uncontrollable"
With more pressure the brush is too soft and the bristles bend away too easily.
With less pressure the tuft-in-tufts are more perceivable between teeth and less perceivable along the gum line.
The perception in-mouth is similar with scrubbing and circular brushing movements.
Early observation: Food residues that were removed from inter-dental areas, stick in bristles and were moved in other inter-dental areas again.
The tuft-in-tufts become "order-less" very easily and bend away, so that the brush looks worn out.

Comparative Example 5

Tuft arrangement: Tufts comprising an inner and an outer group of filaments, the tufts being arranged in four rows next to each other, each row comprising three tufts
Cross-sectional shape of tuft: circular
Diameter of tuft: 3 mm
Length of filaments of inner group: 12.5 mm
Cross-sectional shape of filaments of inner group: circular
Diameter of filaments of inner group: 0.203 mm (8 mil)
Diameter of inner group: 1 mm
Length of filaments of outer group: 11 mm
Cross-sectional shape of filaments of outer group: circular
Diameter of filaments of outer group: 0.1778 mm (7 mil)
Material of all filaments: Nylon PA6.12
Sensorial Evaluation:
The version with increased filament diameter of the higher tufts feels very poky and irritating on gums.
Inter-dental penetration is hardly perceivable, whereas penetration along the gum line is very intensive.
There is not much overall bristles contact, because most contact is only with the higher bristles.
The overall brush rather reminds of a "scratch brush" with little and irritating bristle contact.

Comparative Example 6

Tuft arrangement: Tufts comprising an inner and an outer group of filaments, the tufts being arranged in four rows next to each other, each row comprising three tufts
Cross-sectional shape of tuft: circular
Diameter of tuft: 3 mm
Length of filaments of inner group: 12.5 mm
Cross-sectional shape of filaments of inner group: circular
Diameter of filaments of inner group: 0.1778 mm (7 mil)
Diameter of inner group: 1 mm Length of filaments of outer group: 11 mm
Cross-sectional shape of filaments of outer group: circular
Diameter of filaments of outer group: 0.1778 mm (7 mil)
Material of all filaments: Nylon PA6.12

Sensorial Evaluation:

The level of perceived inter-dental penetration is perceived medium. The bristles are slightly too inflexible to better penetrate between teeth.

Inner tuft too stiff.

The sensory test results clearly show that tufts comprising an inner group of filaments with a diameter of about 0.1524 mm (6 mil) and an outer group of filaments with a diameter of about 0.1778 mm (7 mil) provided very good interdental cleaning perception even when more pressure was applied during brushing. The bristle filed was still stable and the bristles were not bending away. In contrast thereto, tufts comprising an inner and an outer group of filaments with a diameter of about 0.1524 mm (6 mil) provided hardly or only slight interdental perception of the longer filaments. Further, tufts comprising an inner group of filaments with a diameter of about 0.203 mm (8 mil) and an outer group of filaments with a diameter of about 0.1778 mm (7 mil) provided a very poky feeling and were irritating on gums. Inter-dental penetration was hardly perceivable. Tufts comprising an inner and an outer group of filaments with a diameter of about 0.1778 mm (7 mil) resulted in a perception wherein the inner tuft was evaluated as too stiff.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A head for an oral care implement comprising:

a mounting surface, and at least one tuft extending from the mounting surface, wherein the tuft has a longitudinal axis and a cross-sectional area extending in a plane perpendicular to the longitudinal axis, wherein the cross-sectional area has a shape selected from a circular cross-sectional shape and a non-circular cross-sectional shape;

the tuft comprising a first group of filaments and at least a second group of filaments, the first group of filaments being surrounded by the second group of filaments, the filaments of the first group having a longitudinal axis and a cross-sectional area extending in a plane perpendicular to the longitudinal axis, and the cross sectional area having a substantially circular shape with a first diameter, and the filaments of the second group having a longitudinal axis and a cross-sectional area extending in a plane perpendicular to the longitudinal axis, and the cross sectional area having a substantially circular shape with a second diameter, wherein the first diameter is smaller than the second diameter and wherein the first diameter is about 0.15 mm to about 0.16 mm, and the second diameter is about 0.17 mm to about 0.18 mm.

2. The head of claim 1, wherein the filaments of the first group have a first length and the filaments of the second group have a second length different from the first length, whereby there is a difference in length between the first length and the second length.

3. The head of claim 2, wherein the first length is greater than the second length.

4. The head of claim 2, wherein the difference in length is from about 1.1 mm to about 1.9 mm.

5. The head of claim 4, wherein the difference in length is from about 1.3 mm to about 1.7 mm.

6. The head of claim 5, wherein the difference in length is about 1.5 mm.

7. The head of claim 1, wherein at least some of the filaments of the first group and/or at least some of the filaments of the second group are tapered and have a pointed tip.

8. The head of claim 1, wherein the tuft has a free end having a topography selected from the group consisting of a linear shape, a concave shape, a convex shape, a dome shape, or any combination thereof.

9. The head of claim 1, wherein the filaments of the first group differ from the filaments of the second group in at least one characteristic selected from the group consisting of bending stiffness, cross-sectional shape, material, texture, color, and any combination thereof.

10. The head of claim 1, wherein the at least one tuft is inclined relative to the mounting surface of the head at an angle ($\alpha$) defined between the tuft and the mounting surface.

11. The head of claim 10, wherein the angle ($\alpha$) is from about 45° to about 89°.

12. The head of claim 10, wherein the at least one tuft is inclined in a direction that is substantially parallel to the longitudinal extension of the head.

13. The head of claim 10, wherein the head comprises at least a first tuft inclined in a direction towards a distal end of the head and at least a second tuft inclined in a direction towards a proximal end of the head.

14. The head of claim 10, wherein the angle ($\alpha$) is from about 70° to about 80°.

15. The head of claim 1, wherein the tuft is attached to the head by a hot-tufting process.

16. The head of claim 1, wherein the first diameter is about 0.152 mm.

17. The head of claim 1, wherein the second diameter is about 0.178 mm.

18. An oral care implement comprising the head of claim 1.

* * * * *